US010881145B2

(12) United States Patent
Zhao et al.

(10) Patent No.: US 10,881,145 B2
(45) Date of Patent: Jan. 5, 2021

(54) AEROSOL GENERATION COMPONENT AND ASSEMBLY METHOD THEREOF AND ATOMIZER AND ELECTRONIC CIGARETTE

(71) Applicant: Shenzhen First Union Technology Co., Ltd., Shenzhen (CN)

(72) Inventors: Xiaoqiang Zhao, Shenzhen (CN); Renjin Wu, Shenzhen (CN); Yonghai Li, Shenzhen (CN); Zhongli Xu, Shenzhen (CN); Changzheng Dai, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 350 days.

(21) Appl. No.: 15/962,143

(22) Filed: Apr. 25, 2018

(65) Prior Publication Data

US 2018/0325178 A1 Nov. 15, 2018

(30) Foreign Application Priority Data

Apr. 25, 2017 (CN) ..... 2017 2 0441436 U
May 2, 2017 (CN) ..... 2017 1 0301198

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2017/0001854 A1* 1/2017 Li ..... A24F 1/26
2017/0251729 A1* 9/2017 Li ..... A61M 15/06
2017/0258140 A1* 9/2017 Rostami ..... A24F 47/008
2017/0265525 A1* 9/2017 Li ..... A24F 47/008
2017/0273358 A1* 9/2017 Batista ..... A24F 47/008
2017/0360096 A1* 12/2017 Silvestrini ..... F28B 9/08
2018/0325178 A1* 11/2018 Zhao ..... A24F 47/008

FOREIGN PATENT DOCUMENTS

CN 205831076 U 12/2016
EP 3 020 292 A1 5/2016
EP 3 047 743 A1 7/2016
EP 3 097 804 A1 11/2016

* cited by examiner

*Primary Examiner* — James Harvey
(74) *Attorney, Agent, or Firm* — Proi Intellectual Property US; Klaus Michael Schmid

(57) ABSTRACT

An atomization assembly includes a housing tube; and an atomization core disposed in the housing tube; the atomization core includes a heating element for heating and atomizing tobacco liquid, a first liquid conducting layer wrapped around the heating element, and a supporter disposed in the housing tube and configured for fixing the atomization core; the supporter includes an accommodation chamber for receiving the atomization core and at least one gap on a side wall of the supporter, in communication with the accommodation chamber configured for conveying tobacco liquid to the first liquid conducting layer of the atomization core.

14 Claims, 21 Drawing Sheets

AEROSOL GENERATION COMPONENT AND ASSEMBLY METHOD THEREOF AND ATOMIZER AND ELECTRONIC CIGARETTE

TECHNICAL FIELD

The present disclosure relates to the field of electronic cigarette sets, and particularly, to an atomization assembly mounted in an atomizer and a method for assembling the atomization assembly, the atomizer and the electronic cigarette having the same.

BACKGROUND ART

In a process that the tobacco is combusted, the smoke smog contains tens of carcinogens such as tars, which may endanger people's health. Moreover, the smoke smog spreads in the air to form a second-hand smoke, endangering the ambient crowd's health after sucked. Therefore, most public area prohibits smoking, under this circumstances, the electronic cigarette appears.

As shown in FIG. 1, in general, the electronic cigarette includes a power supply set 1, an atomization assembly 2, a mouth piece 3 connected with each other. The atomization assembly 2 includes a heating wire for heating the tobacco liquid to generate an aerosol. Currently most electronic cigarette utilizes a single piece of heating wire, however, a plurality of heating wires are also used to satisfy some special need. For example, a Chinese patent CN201620684382.9 published "ATOMIZER OF ELECTRONIC CIGARETTE WITH PARALLEL TWO ATOMIZATION UNITS" with two heating wires 52 and two atomization units 5 in parallel electrical connection, a beam 63 thereof is configured for separating the two atomization units 5 to prevent touching each other, the atomization effect has a big smog volume, but the absorption effect of the tobacco liquid is not sufficient.

In the current market, the reusable atomizer of the electronic cigarette mostly can be detachable. The prior art atomization core generally includes a heating element and a liquid conducting layer wrapped outside the heating element. The liquid conducting layer generally utilizes a fiber cotton, the wrapping method is wrapping around the heating element more than once, that is wrapping a single-layer fiber cotton multiple times to form the liquid conducting layer. When people are working, the tightness of wrapping each time would be different to some extent, therefore affecting a consistency of the atomizer as well as atomizing effects. When wrapping the fiber cotton overly tight, the efficiency of the tobacco liquid infiltrating in the atomization core is too low, as a result the heating element fails to obtain adequate tobacco liquid. Moreover, the prior art structure of the atomizer can't apply to the electronic cigarette with multiple atomization cores, without broad usages.

SUMMARY

The present disclosure generally relates to an atomization assembly with a high efficiency of the tobacco liquid infiltration as well as a good consistency thereof, an assembling method, an atomizer and an electronic cigarette having the same.

A technical problem to be solved by the present disclosure is to overcome drawbacks of prior art, and to provide an atomizer structure having multiple atomization cores for an electronic cigarette, which has a high absorption ratio of tobacco liquid and a large aerosol volume.

To overcome the above drawbacks, according to embodiments of the present disclosure, an atomization assembly is disclosed including a housing tube; and at least one atomization core disposed in the housing tube; in which, the atomization core includes a heating element for heating and atomizing tobacco liquid, a first liquid conducting layer wrapped around the heating element and a supporter disposed between the housing tube and the atomization core, configured for fixing the atomization core; wherein the supporter comprises an accommodation chamber for receiving the atomization core; and at least one gap formed on a side wall of the supporter; a second liquid conducting layer wrapped around outside of the supporter; the second liquid conducting layer is in communication with the first liquid conducting layer by the gap to convey the tobacco liquid to the first liquid conducting layer;

Furthermore, a side wall of the housing tube includes a plurality of liquid inlets, at least part of the plurality of the liquid inlets are aligned with the gaps.

Furthermore, a fracture surface formed by the first liquid conducting layer wrapped around the heating element is disposed in the gap, facing toward the liquid inlet that is aligned with the gap.

Furthermore, the heating element is a spiral heating wire, a tubular heating net or a tubular heating piece; the first liquid conducting layer adopts a fiber cotton layer that is wrapped around outside the heating element, an aerosol tube is formed inside the heating element.

Furthermore, the first liquid conducting layer adopts one piece of the fiber cotton layer that is wrapped around outside the heating element; the fracture surface formed by two ends of the fiber cotton layer wrapped together is disposed in the gap.

Furthermore, the first liquid conducting layer adopts two pieces of the fiber cotton layers that are wrapped around outside the heating element; the two fracture surfaces formed by four ends of the two pieces of the fiber cotton layers wrapped together are respectively disposed in the symmetrically set gaps.

Furthermore, the atomization assembly includes at least three atomization cores, the supporter includes at least three corresponding accommodation chambers; and a side wall of each accommodation chamber includes a gap formed thereon; between every two adjacent accommodation chambers there is a liquid pipe for allowing the tobacco liquid to flow in.

Furthermore, each of two ends of the heating element respectively includes a connecting wire, one connecting wire is disposed outside the first liquid conducting layer, the other connecting wire is disposed inside the first liquid conducting layer.

Furthermore, a thickness of the second liquid conducting layer is less than that of the first liquid conducting layer.

Furthermore, a method for assembling the atomization assembly includes following steps: wrapping a first liquid conducting layer around outside a heating element to produce one atomization core, and producing a preset number of atomization cores; disposing the atomization cores into corresponding accommodation chambers of a supporter; wrapping a second liquid conducting layer around outside the supporter; and disposing the supporter incorporating the atomization cores into a housing tube.

Furthermore, the first liquid conducting layer adopts one or two fiber cotton layers wrapped around the heating element; after disposing the atomization cores into the corresponding accommodation chambers of the supporter, the method further includes: cutting away redundant fiber cotton layers extending out of a gap to let the two ends of the fiber cotton layers be aligned with the gap.

Furthermore, when disposing the supporter incorporating the atomization cores into the housing tube, the gap is aligned with a liquid inlet of the housing tube.

Furthermore, an atomizer includes: a shell component, having a tobacco liquid chamber formed therein; and an atomization assembly disposed inside the shell component and can be referred to the aforementioned atomization assembly, configured for heating tobacco liquid from the tobacco liquid chamber to generate an aerosol.

Furthermore, an electronic cigarette includes the aforementioned atomizer, and a power supply, connected with the atomizer and configured for supplying power to the atomizer.

Compared to the existing technologies of wrapping the fiber cotton layer multiple times known to the inventors, the atomization assembly in the present disclosure utilizes a brand new assembling way: adopting a first liquid conducting layer and a second liquid conducting layer that are all single-layer fiber cottons, which may avoid discrepancy of tightness in manually wrapping the fiber cotton layer multiple times to influence efficiency of infiltration of the tobacco liquid. Moreover, a second liquid conducting layer is wrapped around outside the supporter, able to conduct the tobacco liquid to infiltrate through the gaps of the supporter, which is suitable for a plurality of atomization cores working at the same time. Furthermore, the fracture surface of the first liquid conducting layer is disposed in the gap to aid the tobacco liquid's infiltration, so that the tobacco liquid supplied to the heating element is sufficient.

To solve the above problems, a technological scheme is used hereinafter: an electronic cigarette with multiple atomization cores including an atomization assembly; the atomization assembly including a housing tube; and at least two first liquid conducting layers disposed in the housing tube; inside of each first liquid conducting layer having a heating wire; a supporter disposed between the housing tube and the first liquid conducting layers; a side wall of the housing tube has multiple liquid inlets, each first liquid conducting layer is corresponding with each liquid inlet; a side wall of the first liquid conducting layer contacts a side wall of the adjacent first liquid conducting layer.

The atomizer further includes a hollow shell component shaped like a cylinder; the housing tube of the atomization assembly is disposed inside the shell component of the atomizer. A connecting sleeve is disposed on upper side of the housing tube. A sealing element is carried on the connecting sleeve. An inside wall of the shell component, an outside wall of the housing tube, a connecting sleeve and a sealing element cooperatively encompass a liquid storage chamber.

The upper side of the sealing element is a cover component; the connecting sleeve, the sealing element and the cover component are all hollow structures, cooperatively defining an aerosol tube therein.

The mouth piece is a hollow structure, fixed at middle of the cover component.

The liquid storage chamber is configured for storing tobacco liquid.

The numbers of the first liquid conducting layers and the heating wires are both three; a side wall of each first liquid conducting layer contacts side walls of the adjacent two first liquid conducting layers.

Additional aspects and advantages of the present disclosure will be: the atomizer incorporating multiple atomization cores can produce larger volume of smoke smog, side walls of the multiple first liquid conducting layers contacting with each other enable the tobacco liquid to infiltrate among multiple first liquid conducting layers, therefore avoiding that one piece of the first liquid conducting layer in usage absorbs insufficient tobacco liquid resulting in burnt flavor in the aerosol, meanwhile, utilizing multiple first liquid conducting layers aids rapid conductivity of the heat to avoid very hot aerosol sucked by a user.

DETAILED DESCRIPTION

Provided herein are an atomization assembly, an atomizer, an electronic cigarette having the same and a working principle thereof.

Figure 1:
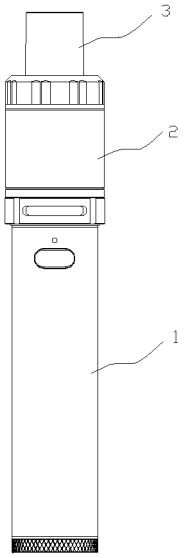
PRIOR ART FIG. 1
FIG. 1 is a front aspect view of a prior art electronic cigarette.
Figure 2:
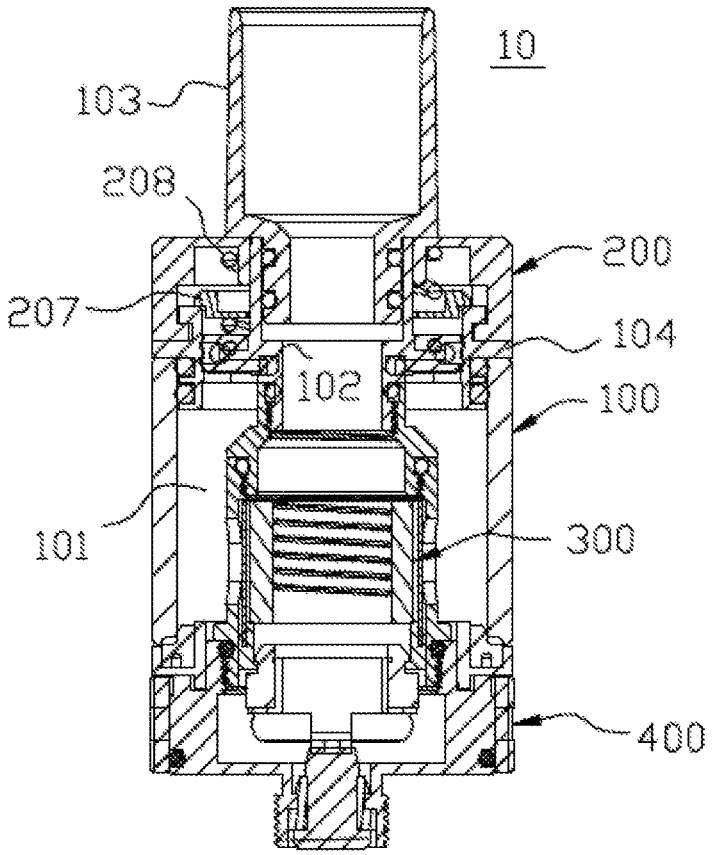
FIG. 2 is a cross-sectional view of a replaceable atomizer according to an embodiment of the present disclosure.

Referring to FIG. 2, an embodiment of the present disclosure relates to an atomizer 10 with refilling tobacco liquid including a shell component 100, a cover component 200 and a base component 400 respectively connected with two ends of the shell component 100, and an atomization assembly 300 disposed inside the shell component 100. The shell component 200 has a liquid storage chamber 101 formed therein. Two ends of the liquid storage chamber 101 are respectively sealed by the cover component 200 and the base component 400. When users dismantle the cover component 200, it is available to add the tobacco liquid into the liquid storage chamber 101. The atomization assembly 300 is connected with the power supply by the base component 400, when users dismantle the base component 400, it is available to replace the inside atomization assembly 300. In addition, the above cover component 200 further has a mouth piece 103 mounted thereon, inside of the mouth piece 103 is in communication with inside of the atomization assembly 300. The atomization assembly 300 is configured for atomizing the tobacco liquid from the liquid storage chamber 101 to generate an aerosol, and then users may suck the aerosol via the mouth piece 103.

Figure 3:
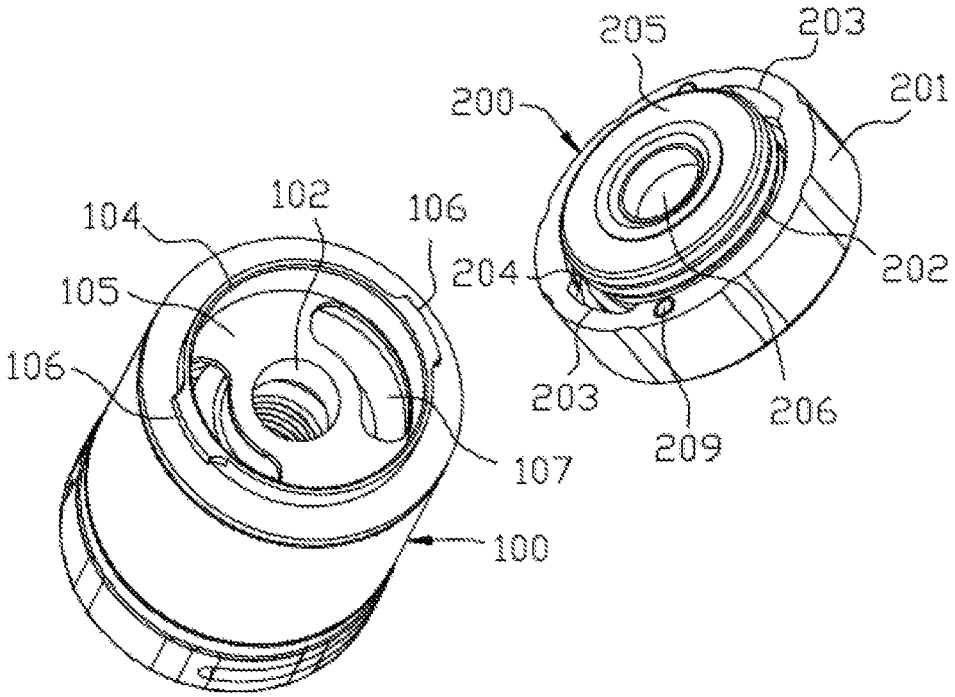
FIG. 3 is a cross-sectional view of a shell component and a cover component connected in the atomizer according to an embodiment of the present disclosure.

With reference to FIG. 3, the shell component 100 has an injection end 104 that has at least one injection port 107 in communication with the liquid storage chamber 101. More specifically, in the embodiment, the injection end 104 has a surface 105, the cover component 200 abuts against the surface 105. The surface 105 has two symmetrical injection ports 107 formed thereon. The surface 105 has an air pipe 102 formed at the middle thereof, where the air pipe 105 is in communication with inside of the aforementioned atomization assembly 300.

The aforementioned cover component 200 is detachably connected with the injection end 104 and configured to open or close the injection port 107. When users dismantle the cover component 200, the users may add the tobacco liquid into the injection port 107 by using an injection container. The cover component 200 and the injection end 104 with corresponding snapping structures are clamped by snap joint, that is, after the cover component 200 is inserted into the injection end 104, the cover component 200 is rotated to a certain angle to be clamped with the injection end 104. Compared to the thread connection in the prior art, apart from the connection way of snap joint is simple to reduce the product cost, it only needs to rotate a certain angle to dismantle the cover component 200, the operation is quite easy.

More specifically, as one example of the snap joint structures, the injection end 104 has at least one protrusions 106, in some embodiments, there are two protrusions 106, inner wall of the cover component 200 has a undercut 203 along an axial direction thereof, and an curved undercut 204 along an circumferential direction thereof to match with insertion of the two protrusions 106. When the cover component 200 is connected with the shell component 100, the protrusion 106 inserts into the curved undercut 204 along the undercut 203 and is rotated to a certain angle to catch with the curved undercut 204. In some embodiments, the curved undercut 204 has a positioning structure configured to restrain the rotated angle of the injection end 104, such as to rotate the injection end 104 to 120 degree. On the contrary, to rotate the injection end 104 back to 120 degree may dismantle the injection end 104 from the cover component 200. The aforementioned positioning structure includes a pair of positioning columns 209 extending convexly from inner wall of the curved undercut 204 to stop the protrusion 106 to move.

Figure 4:
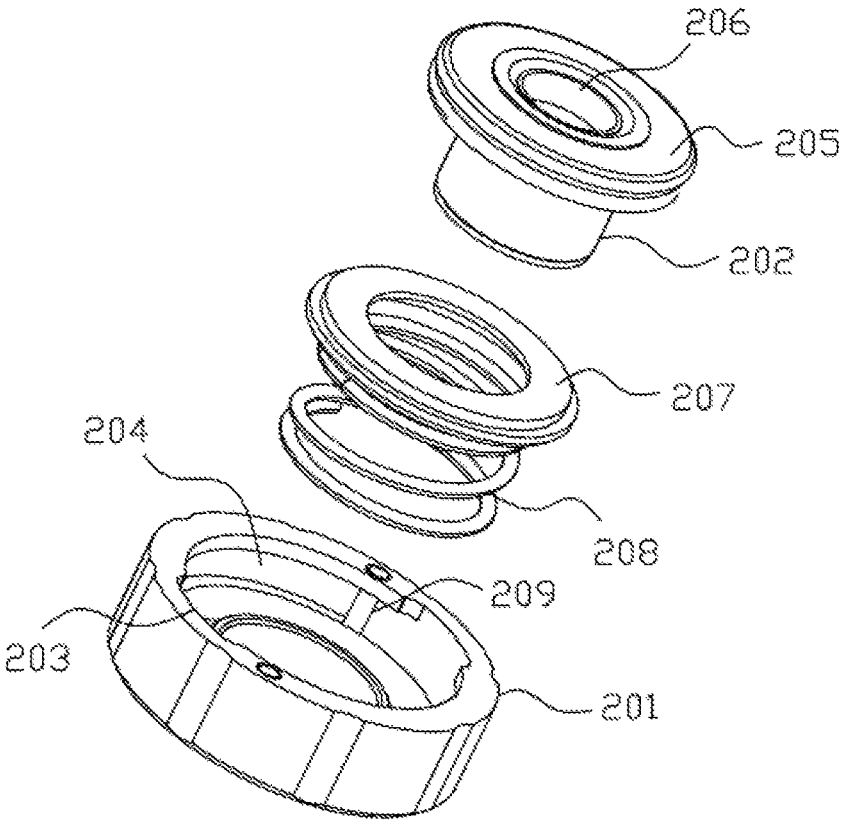
FIG. 4 is an exploded view of the cover component according to an embodiment of the present disclosure.

With reference to FIG. 3 and FIG. 4, at the bottom of the cover component 200 there is a sealing part 205 configured for sealing the injection port 107 when the cover component 200 is snapped with the injection end 104. More specifically, the cover component 200 includes a cover 201 at top of the injection end 104 and a base 202 connected with the cover 201, the sealing part 205 is carried on the base 202. The cover component 201 is sleeved on the base 202 which are fixed with each other; there is a clearance between each other to receive insertion of the injection end 104. The base 202 has a hollow chamber 206 through the base 206, when the sealing part 205 abuts against a surface 105 of the injection end 104, one end of the hollow chamber 206 is in communication with the air pipe 102, while the mouth piece 103 is inserted to be connected with the other end of the hollow chamber 206, therefore, the mouth piece 103 is in communication with the air pipe 102 by using the hollow chamber 206.

In some embodiments, the cover component 200 further includes an elastic element, when the cover component 200 is snapped with the injection end 104, the elastic element abuts against the injection end 104. The elastic element includes a spring 208 and a lap joint 207 abutting against the spring 208, when the cover component 200 is snapped with the injection end 104, the spring 208 is pressed so that the lap joint 207 driven by the spring 208 is lapped with the injection end 104, therefore, the rotational friction between the cover component 200 and the injection end 104 gets larger to prevent the cover component 200 from falling off because of faulty operations, so as to prevent leakage of the tobacco liquid.

Figure 5:
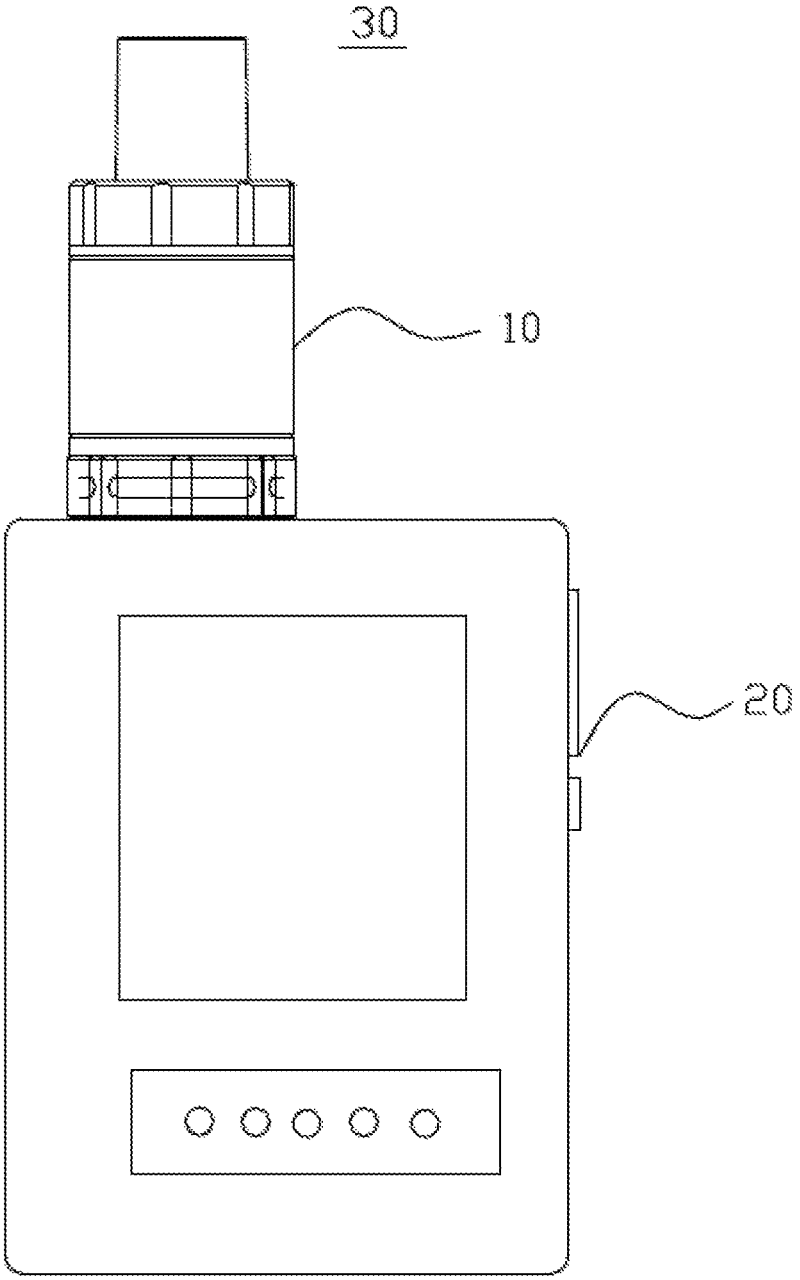
FIG. 5 is an aspect view of the electronic cigarette according to an embodiment of the present disclosure.

With reference to FIG. 5, some embodiments of the present disclosure relate to an electronic cigarette 30 including the aforementioned atomizer 10 and a power supply 20 connected with the atomizer 10, the power supply 20 is electrically connected with the aforementioned base component 400 to supply power to the atomization assembly 300.

FIGS. 6A to 6F show an atomization assembly 300 having one atomization core and the assembling process thereof.

The above atomization assembly 300 includes a housing tube 301 and an atomization core 302 disposed in the housing tube 301; the atomization core 302 includes a heating element 306 for heating and atomizing the tobacco liquid, and a first liquid conducting layer 304 wrapped around the heating element 306, a supporter 303 disposed between the housing tube 301 and the atomization core 302, and configured for fixing the atomization core 302. The supporter 303 has an accommodation chamber 3031 for receiving the atomization core 302 and at least one gap 3032 opened on a side wall of the supporter 303; in this embodiment, there are two symmetrically arranged gaps 3032. A second liquid conducting layer 305 is wrapped around outside of the supporter 303. The second liquid conducting layer 305 is in communication with the first liquid conducting layer 304 by the gaps 3032 to convey the tobacco liquid to the first liquid conducting layer 304, further the tobacco liquid is heated and atomized by the heating element 306.

In these embodiments, a thickness of the second liquid conducting layer 305 is less than that of the first liquid conducting layer 304, so that the infiltration of the tobacco liquid from the liquid storage chamber 102 to the first liquid conducting layer 304 is speeded up. And thicker first liquid conducting layer 304 may absorb more tobacco liquid to supply sufficient tobacco liquid to the heating element 306. Moreover, the second liquid conducting layer 305 is disposed in the clearance between the housing tube 301 and the supporter 303, avoiding the leakage of the tobacco liquid in the liquid storage chamber 102 from the clearance between the housing tube 301 and the supporter 303.

Furthermore, a side wall of the housing tube 301 has a plurality of liquid inlets 3011, at least part of the plurality of the liquid inlets 3011 are aligned with the gaps 3032 of the supporter 303. And a fracture surface 3041 formed by the first liquid conducting layer 304 wrapped around the heating element 306 is disposed in the gap 3032, rightly facing toward the liquid inlet 3011 that is aligned with the gap 3032. More specifically, in the embodiment, the side wall of the housing tube 301 has four liquid inlets 3011, of which, two opposite liquid inlets are set aligned with the symmetrical gaps 3032 respectively, which aids infiltration of the tobacco liquid from the second liquid conducting layer 305 to the first liquid conducting layer 304 further to the heating element 306 successively. Moreover the fracture surface 3041 of the first liquid conducting layer 304 is disposed in the gap 3032, which further aids infiltration inward of the tobacco liquid. Therefore, the tobacco liquid is sufficient to supply.

In some embodiments, the heating element 306 is a spiral heating wire; the first liquid conducting layer 30 adopts a fiber cotton layer that is wrapped around outside the heating element 306, an aerosol tube 307 is formed inside the heating element 306. The atomized aerosol is guided to the air pipe 102 through the aerosol tube 307. Of course, the heating element 306 may adopt other normal structures such as a tubular heating net or a tubular heating piece etc.

Figure 6A:
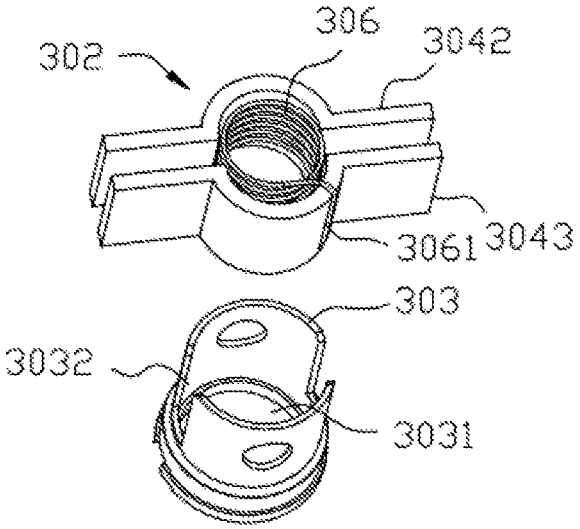
FIGS. 6A-6F show an assembling process that the atomization assembly has one atomization core according to an embodiment of the present disclosure.
Figure 6B:
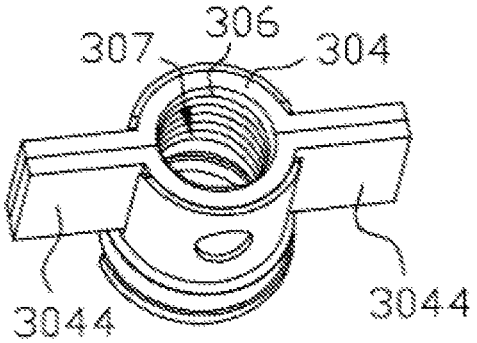

With reference to FIG. 6A and FIG. 6B, the first liquid conducting layer 304 adopts two pieces of fiber cotton layers 3042, 3043 wrapped around outside the heating element 306. Two fracture surfaces 3041 formed by four ends of two separate fiber cotton layers 3042, 3043 wrapped together are respectively disposed in two symmetrical gaps.

In some embodiments, each of two ends of the heating element 306 respectively has a connecting wire, one connecting wire 3061 is disposed outside the first liquid conducting layer 304, the other connecting wire (not shown) is disposed inside the first liquid conducting layer 304, to avoid shortage of the two connecting wires at two ends of the heating element 306. The connecting wire 3061 situated outside of the first liquid conducting layer 304 acts as a negative electrode to contact the housing tube 301. The connecting wire situated inside of the first liquid conducting layer 304 acts as a positive electrode to contact an electrode collar that is carried on a bottom end of the housing tube 301.

The assembling method for assembling the atomization assembly 300 will be interpreted hereinafter according to the assembling sequence as shown in FIGS. 6A to 6F.

As shown in FIG. 6A, firstly an atomization core 302 is manufactured, wrapping two pieces of pre-pressed fiber cotton layers 3042, 3043 around outside the heating element 306 to form a single-layer first liquid layer 304, then closing two ends of each of the fiber cotton layers 3042,3043 together, while letting the connecting wire 3061 at one end of the heating element 306 cross over the first liquid layer 304 to extend downward along the outside of the first liquid layer 304, and disposing the connecting wire at the other end of the heating element 306 inside first liquid conducting layer 304.

As shown in FIG. 6B, the manufactured atomization core 302 is disposed inside the corresponding accommodation chamber 3031 of the supporter 303, closing two ends of each of two fiber cotton layers 3042, 3043 together and letting redundant fiber cotton layers 3044 extending out of the symmetrical gaps 3032 of the supporter 303. The thickness of the fiber cotton layers 3042, 3043 may be predetermined to tightly contact insider the supporter 303.

Figure 6C:
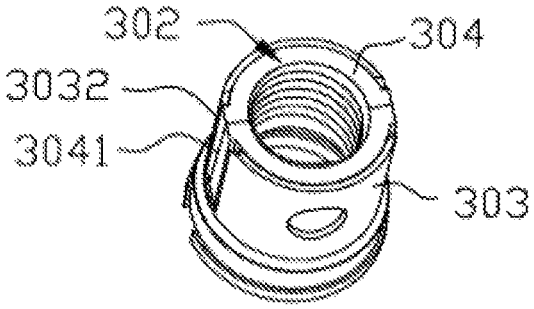

As shown in FIG. 6C, cutting away the redundant fiber cotton layers 3044 so that the ends of the two fiber cotton layers 3042, 3043 are basically aligned with the gaps 3032, or slightly overhang the gaps 3032.

Figure 6D:
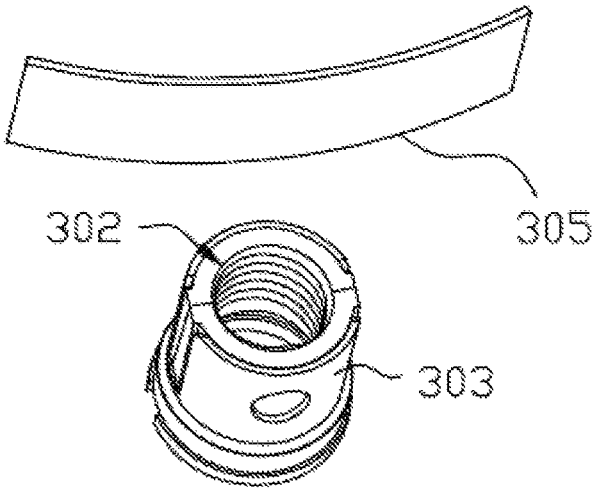

As shown in FIG. 6D, wrapping another one piece of the fiber cotton layer with a less thickness around outside the supporter 303 to form a second liquid conducting layer 305; to be understood, the second liquid conducting layer 305 may be made of non-woven fabrics or other polymer foam fiber layer materials.

Figure 6E:
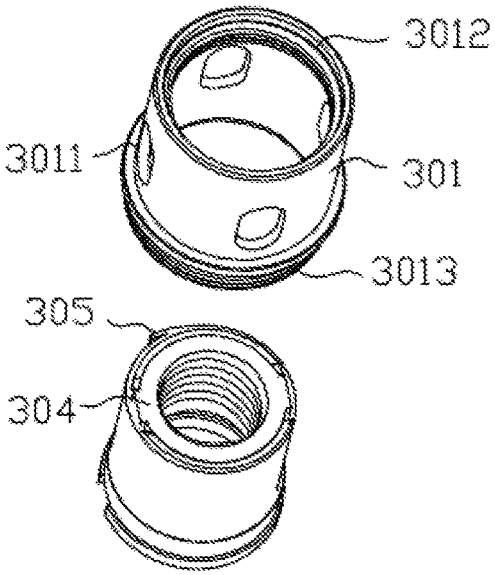

As shown in FIG. 6E, the supporter 303 incorporating inside atomization core 302 as a whole is disposed in the housing tube 301. It should be noticed, the two gaps 3032 of the supporter 303 are aligned with two of liquid inlets 3011 of the housing tube 301 respectively.

Figure 6F:
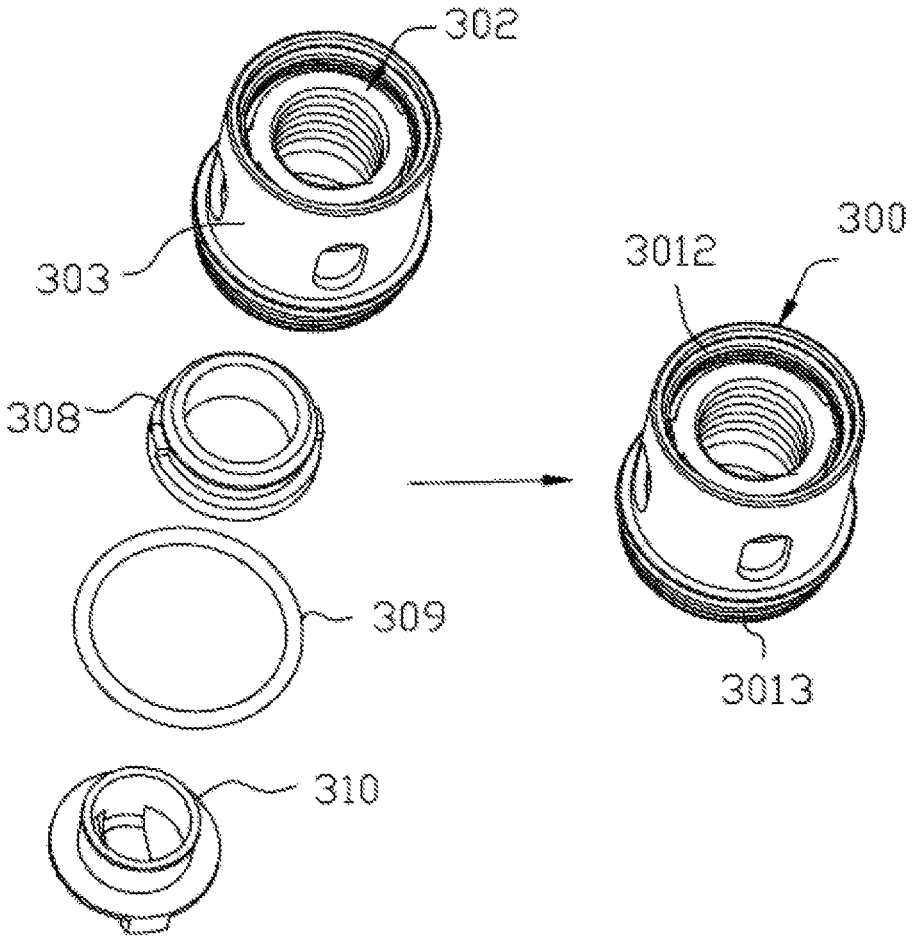
Figure 7A:
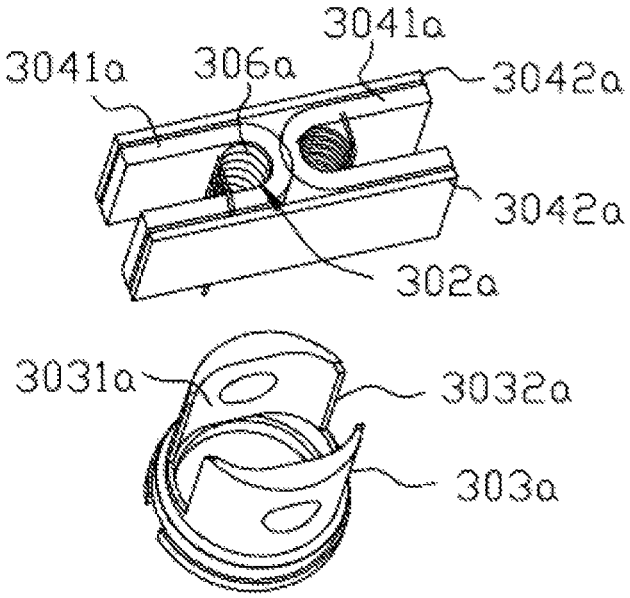
FIGS. 7A-7D show an assembling process that the atomization assembly has two atomization cores according to an embodiment of the present disclosure.
Figure 7B:
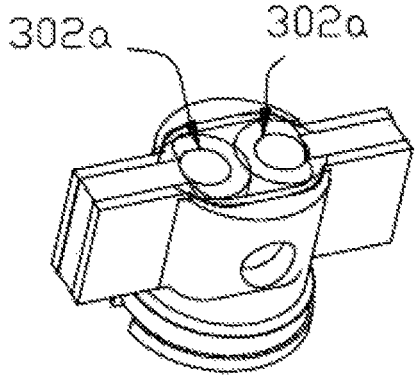
Figure 7C:
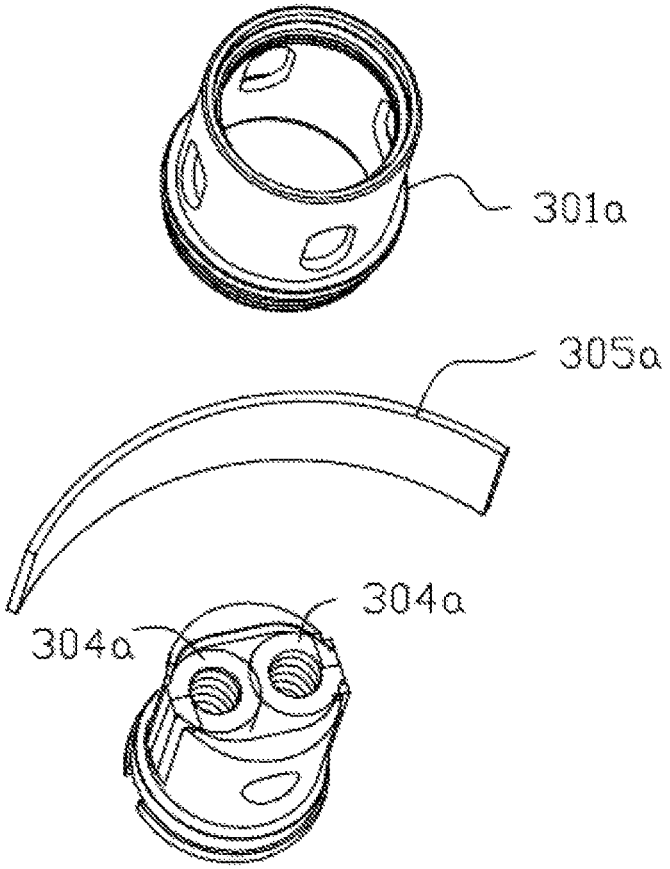
Figure 7D:
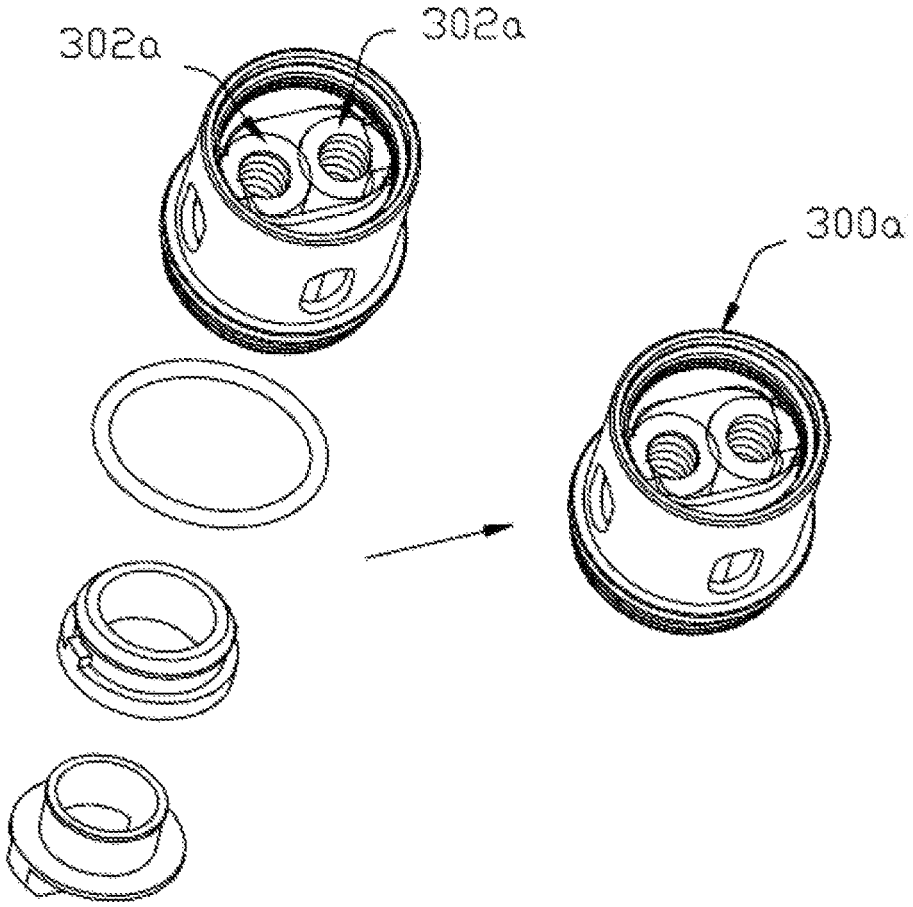

As shown in FIG. 6F, finally, an insulating ring 308, a sealing ring 309 and an electrode collar 310 are successively mounted at the bottom end of the housing tube 301. The insulating ring 308 may insulate the electrode collar 310 from the housing tube 301 and the supporter 303. Meanwhile, two ends of the housing tube 301 respectively define thread parts 3012, 3013, the thread part 3012 is set for connecting with the air pipe 102, and the thread part 3013 is set for connecting with the base component 400. The sealing ring 309 is sleeved on the bottom end of the housing tube 301 to prevent leakage of the tobacco liquid between the atomization assembly 300 and the base component 400.

Likewise, as shown in FIGS. 7A to 7D, the present disclosure relates to an atomization assembly 300*a* incorporating two atomization cores 302*a*, each of the two atomization cores 302*a* has a same structure with the above atomization core 302 as shown in FIGS. 6A to 6F, and both are arranged into the accommodating chamber 3031*a* of the supporter 303*a*. In some variations, the two atomization cores 302*a* are disposed in two spaced accommodation chambers of the supporter 303*a*.

In the process of assembling the atomization assembly 300*a*, firstly two atomization cores 302*a* are manufactured, wrapping one piece of fiber cotton layer 3041*a* around outside the heating element 306*a*, and closing two ends of the fiber cotton layer 3041*a* together to produce a first liquid layer 304*a*; then using two piece of fiber cotton layers 3042 to respectively clamp two sides of the two atomization cores 302*a* so as to fix the two atomization cores 302*a*, then as a whole, being disposed inside the accommodation chamber 3031*a* of the supporter 303*a*; further removing redundant fiber cotton layers from the gaps 3032*a* where two ends of the fiber cotton layer 3041*a* are closed together; then wrapping the second liquid layer 305*a* around outside the supporter 303*a* and disposing the supporter incorporating the two atomization cores 302*a* into the housing tube 301*a*, finally carrying the electrode collar etc. some components on to assemble the atomization assembly 300*a*.

It is noted, the first liquid layers 304*a* within the two atomization cores 302*a* contact interactively in the accommodation chamber 3031*a* in favor of conveying the tobacco liquid, avoiding one atomization core 302*a* lacks the tobacco liquid to burn overly and further produce burnt flavor.

As shown in FIGS. 8A to 8E, the present disclosure relates an atomization assembly 300*b* incorporating three atomization cores 302*b*. More specifically, the atomization assembly 300*b* has a housing tube 301*b* and three atomization cores 302*b* disposed in the housing tube 301*b*. The atomization core 302*b* includes a heating element 306*b* for atomizing the tobacco liquid and a first liquid conducting layer 304*b* wrapped around outside the heating element 306*b*. The housing tube 301*b* has a supporter 303*b* for fixing three atomization cores 302*b*. The supporter 303*b* has three spaced accommodation chambers 3031*b* along an axial direction for receiving three atomization cores 302*b*, a side wall of each accommodation chamber 3031*b* has a gap 303*b*, aiding infiltration of the tobacco liquid from the second liquid conducting layer 305*b* into each atomization core 302*b*.

Figure 8A:
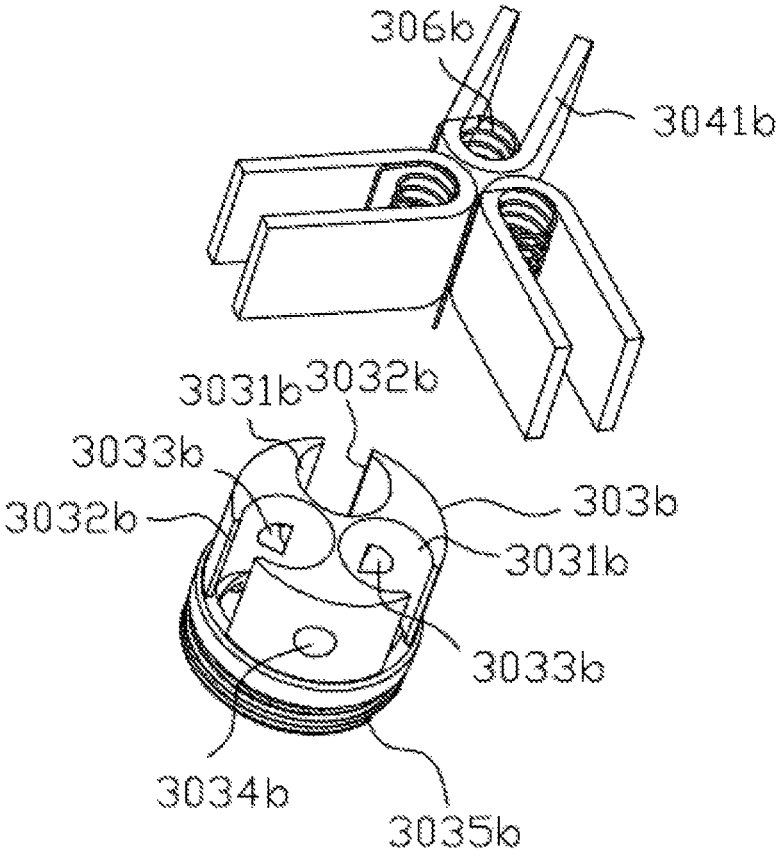
FIGS. 8A-8E show an assembling process that the atomization assembly has three atomization cores according to an embodiment of the present disclosure.
Figure 8B:
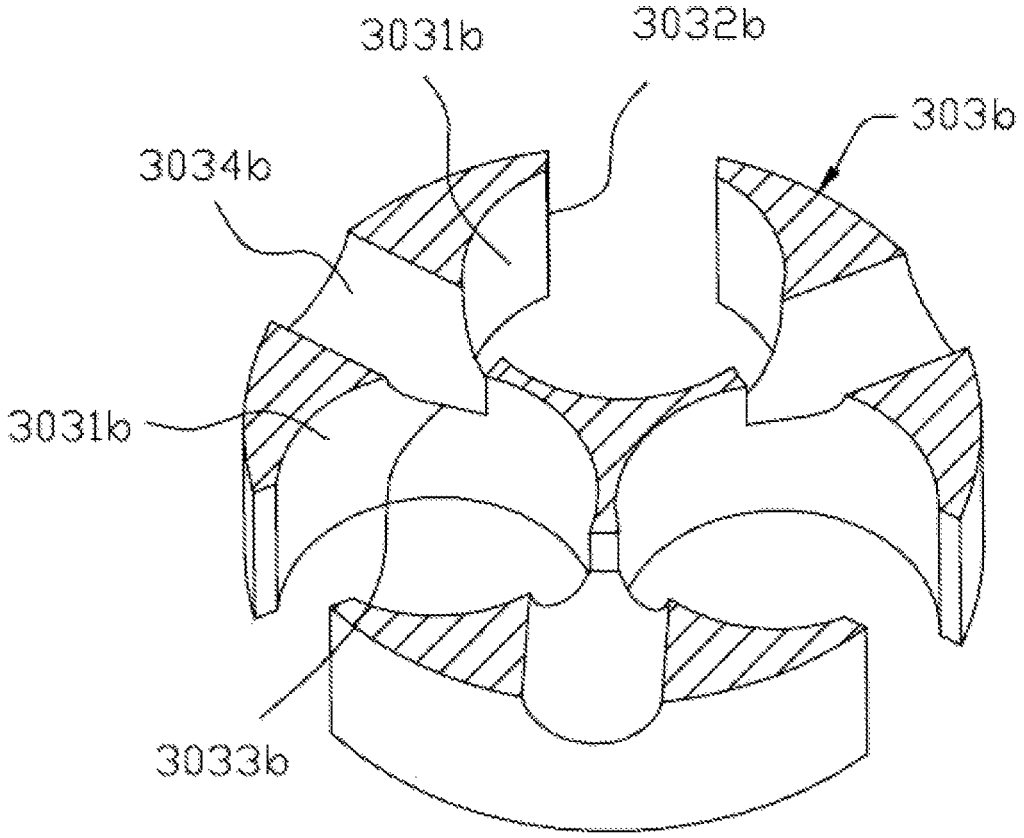
Figure 8C:
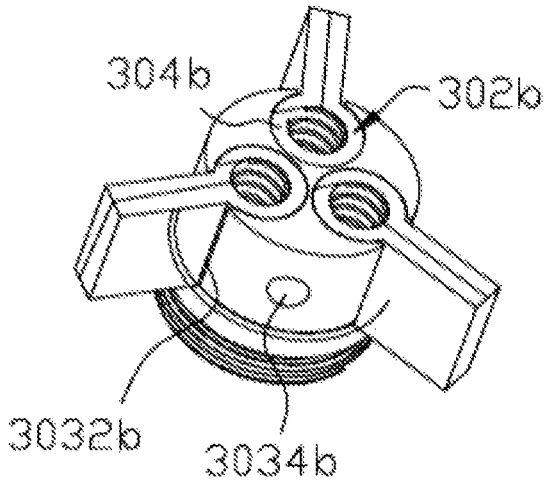
Figure 8D:
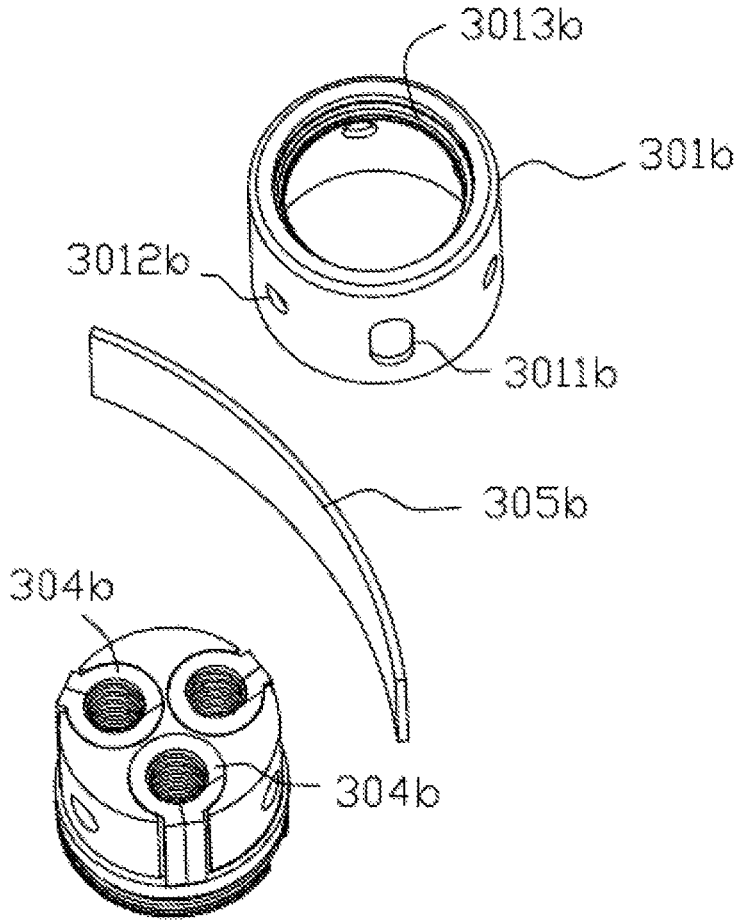
Figure 8E:
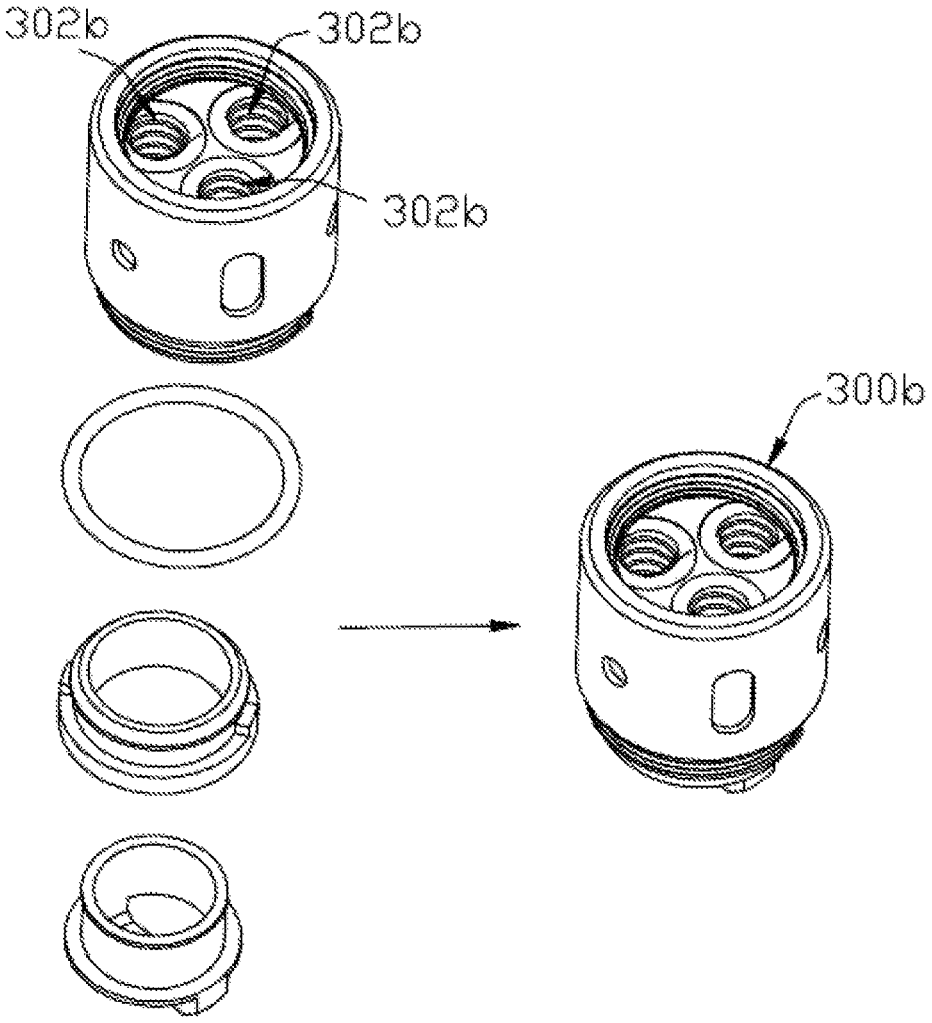
Figure 9A:
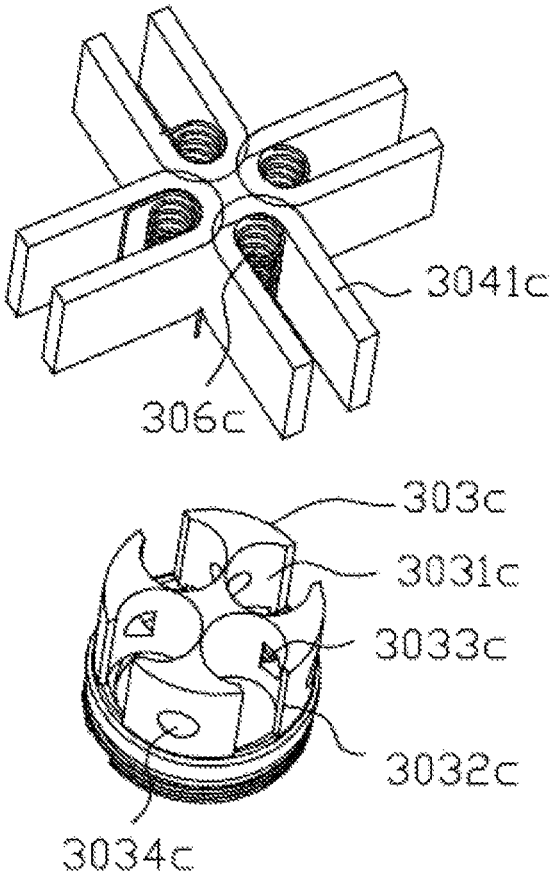
FIGS. 9A-9D show an assembling process that the atomization assembly has four atomization cores according to an embodiment of the present disclosure.
Figure 9B:
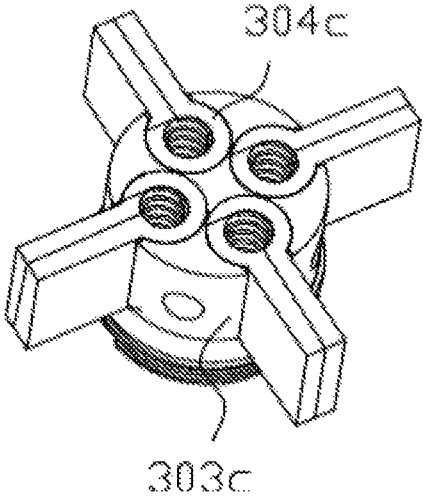
Figure 9C:
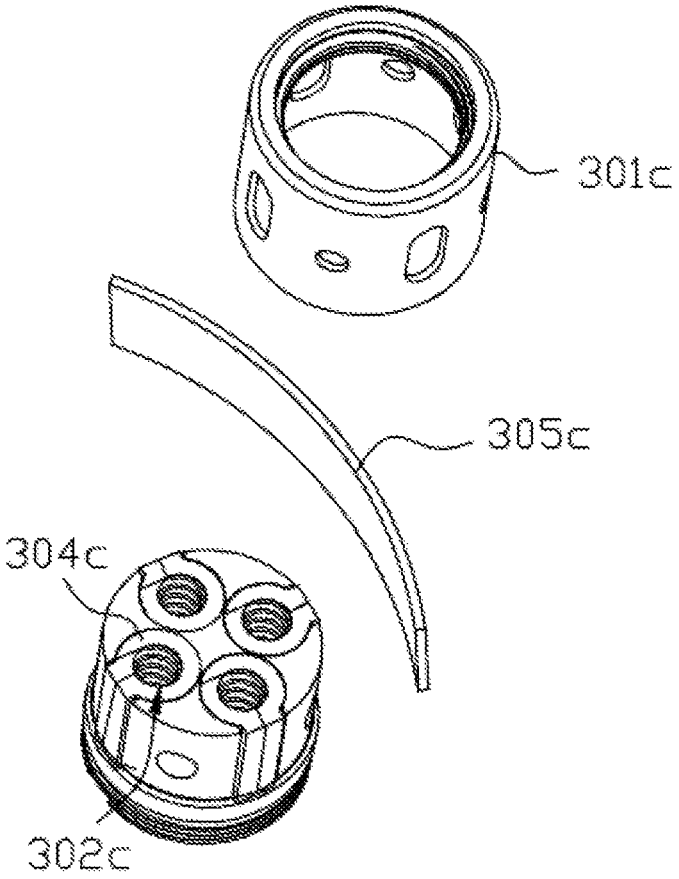
Figure 9D:
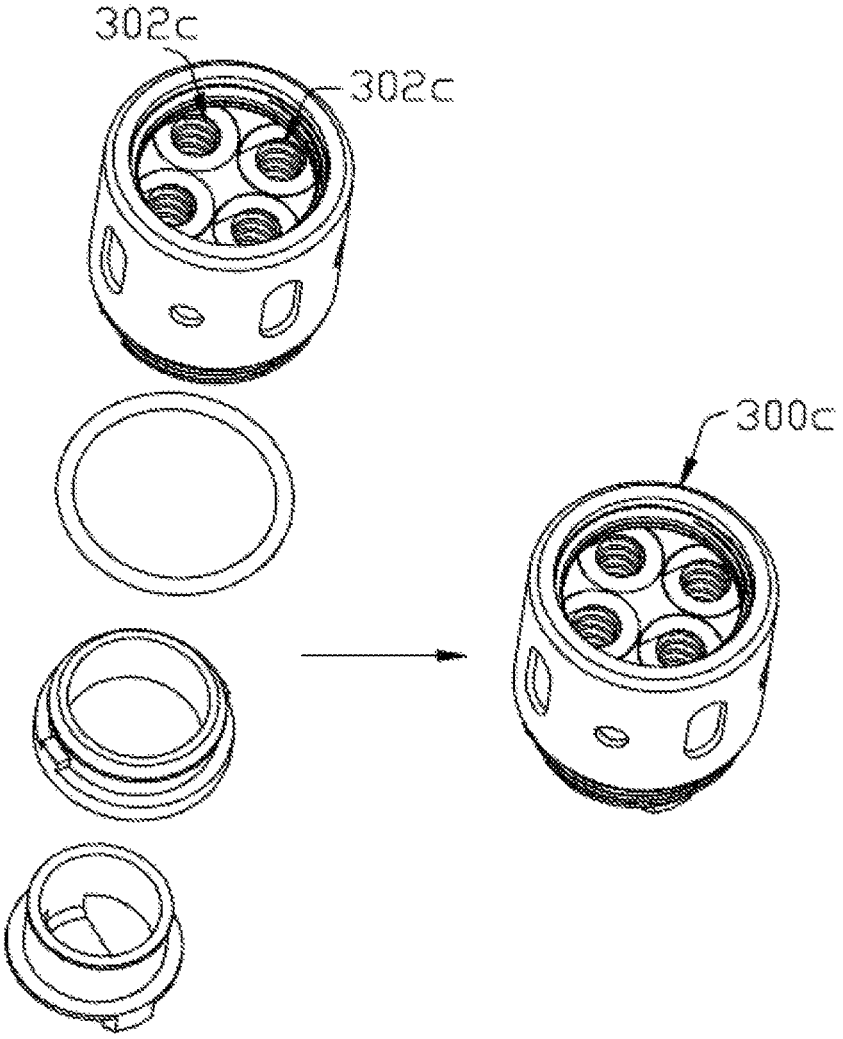

As shown in FIGS. 8A to 8B, in some embodiments, to optimize a way the tobacco liquid infiltrates into the atomization core 302*b*, for the three atomization cores 302*b*, between every two adjacent accommodation chamber 3031*b* there is a liquid pipe 3033*b* for allowing the tobacco liquid to flow in, therefore, the tobacco liquid infiltrates or flows among the three atomization cores 302*b* interactively by the liquid pipes 3033*b*, avoiding one atomization core 302*b* lacks the tobacco liquid to burn overly to produce burnt flavor.

In order to further improve infiltration efficiency of the tobacco liquid to each atomization core 302*b*, the side wall of the supporter 303*b*, between two adjacent gaps 3031*b*, further includes a liquid infiltrating hole 3034*b* in communication with the liquid pipe 3033*b*. The liquid infiltrating hole 3034*b* is communicated with two adjacent accommodation chambers 3031*b* that are corresponding to the two adjacent gaps 3031*b*, through the liquid pipe 3033*b*. Apart from infiltrating into the atomization core 302 through the gap 3032 of each accommodation chamber 3131*b*, the tobacco liquid from the above second liquid conducting layer 305*b* may infiltrate into the adjacent two atomization cores 302*b* through the liquid pipe 3033*b*, therefore improving the infiltration efficiency of the tobacco liquid and ensuring sufficient tobacco liquid to supply.

Accordingly, the housing tube 301*b* has a first liquid inlet 3011*b* and a second liquid inlet 3012*b* dispersed at interval on a side wall thereof. The first liquid inlet 3011*b* is square, rectangular or oval, aligned with the gap 3031*b* while the fracture surface formed by the first liquid conducting layer 304*b* and disposed in the gap 3031*b* rightly faces toward the first liquid inlet 3011*b*. However, the second liquid inlet 3012*b* is aligned with the liquid infiltrating hole 3034*b*.

It is noted that, a difference between the structure of the atomization assembly 300*b* and the structure of above atomization assembly 300 is: in the atomization assembly 300*b*, the thread part 3013*b* connected with the air pipe 102 is arranged on top end of the housing tube 301 but the thread part 3035*b* connected with the base component 400 is arranged on bottom end of the supporter 303*b*.

The manufacture process of the atomization assembly 300*b*, according to the assemble sequence as shown in FIGS. 8A to 8E, is similar with the aforementioned atomization assembly 300*a* incorporating two atomization cores: firstly three atomization cores 302*b* are manufactured, that is, wrapping one piece of the fiber cotton layer 3041*b* around outside the heating element 306*b* and closing two ends of the fiber cotton layer 3041*b* together, to produce a first liquid conducting layer 304*b* outside the heating element 306*b*; disposing three atomization cores 302*b* into three different accommodating chamber 3031*b* respectively, cutting away the redundant fiber cotton extending out of the gaps 3032 after two ends of the fiber cotton layer 3041*b* are closed together; wrapping a second conducting layer 305*b* around the supporter 303*b* and disposing the supporter 303*b* incorporating three atomization cores 302 *b* into the housing tube 301*b*, finally carrying on some components such as the electrode collar etc., to manufacture the atomization assembly 300*b*.

As shown in FIGS. 9A to 9D, an atomization assembly 300*c* incorporating four atomization cores is disclosed according to an embodiment of the present disclosure. The atomization assembly 300*c* includes a housing tube 301*c*, a supporter 303*c* and the four atomization cores 302*c* arranged in the supporter 303*c*. The supporter 303*c* has four accommodation chamber 3031*c* along an axial direction of the supporter 303*c*. Likewise, the atomization core 302*c* includes a heating element 306*c* and a first liquid conducting layer 304*c* wrapped around the heating element 306*c*. In some embodiments, the atomization core 302*c* further includes a second liquid conducting layer 305*c* wrapped around outside the supporter 303*c*.

The structure of the atomization assembly 300*c* incorporating four atomization cores 302*c* is similar to the above atomization assembly 300*b* incorporating three atomization cores 302*b*. In the atomization core 300*c*, each of the four first liquid conducting layers 304*c* are all formed by only one piece of fiber cotton layer 3041*c* wrapped around the heating element 306*c*, then two ends of the fiber cotton layer 3041*c* are closed together, cutting away the redundant fiber cotton. Similarly, between every two adjacent accommodation chamber 3031*c* there is a liquid pipe 3033*c* for allowing the tobacco liquid to flow in. And the side wall of the supporter 303*c*, between two adjacent gaps 3032*c*, further includes a liquid infiltrating hole 3034*c*. The process of assembling the atomization core 300*c* refers to the assembling sequence as shown in FIGS. 9A to 9D, which also refers to the process of assembling the atomization core 300*b* incorporating three atomization cores, without reiterating it herein.

It should be noted, the above embodiments refer to the atomization assembly incorporating one to four atomization cores, but not exclusive of the atomization assembly incorporating more atomization cores. The atomization assemblies incorporating different number of atomization cores may be exchanged according to the aerosol volume and taste needed by the user.

Figure 10:
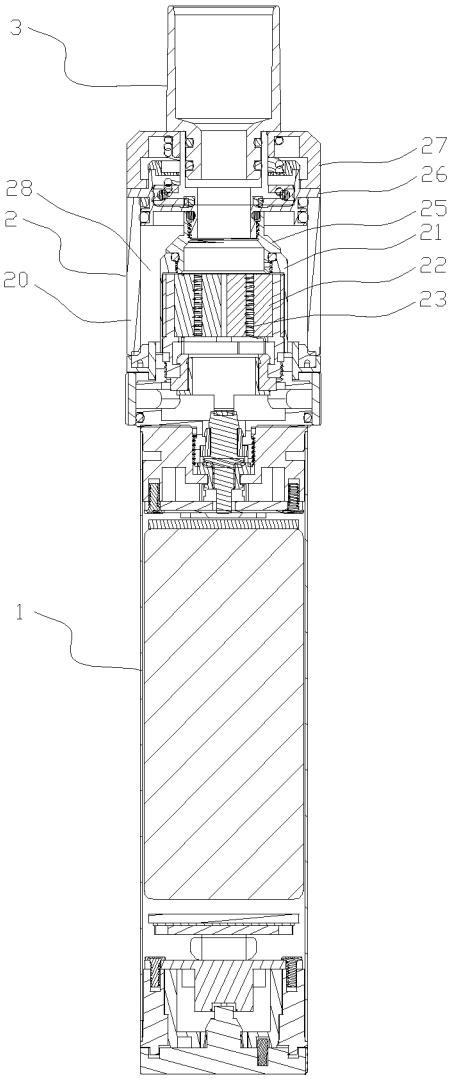
FIG. 10 is a cross-sectional view of the atomization assembly having multiple atomization cores according to first embodiment of the present disclosure.
Figure 11:
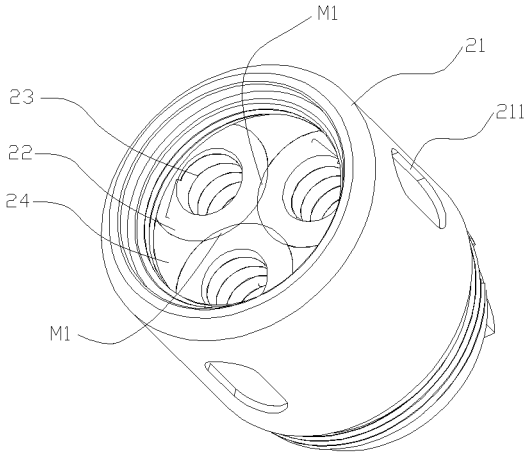
FIG. 11 is an isometric view of the atomization assembly having multiple atomization cores according to the first embodiment of the present disclosure.

As shown in FIGS. 10 and 11, en electronic cigarette having three atomization cores includes a battery assembly 1, an atomization assembly 2 and a mouth piece 3 connected with each other. Outside of the atomization assembly has a hollow shell component shaped like a cylinder. Inside of the atomization assembly further has a housing tube 21. Inside of the housing tube 21 has a first liquid conducting layer 22 (e.g. an absorbing cotton layer) and a heating wire 23. The housing tube 21 is shaped like a barrel. A supporter 24 is disposed between the housing tube 21 and the first liquid conducting layer 22, configured for fixing position of the first liquid conducting layer 22. The first liquid conducting layer 22 is a hollow cylindrical structure; the first liquid conducting layer 22 is arranged surrounding the heating wire 23. The side wall of the housing tube 21 has a plurality of liquid inlets 211; each liquid inlet is corresponding with the first liquid conducting layer 22.

The upper side of the housing tube 21 has a connecting sleeve 25, a sealing element 25 is carried on the connecting sleeve 25. The upper side of the sealing element 26 is a cover component 27; the mouth piece 3 is disposed on the cover component 27. The above connecting sleeve 25, the sealing element 26 and the cover component 27 are all hollow structures, cooperatively forming an aerosol pipe. An inside wall of the shell component 20, an outside wall of the housing tube 21, a connecting sleeve 25 and a sealing element 26 cooperatively encompass a liquid storage chamber 28. The liquid storage chamber is configured for storing the tobacco liquid. The tobacco liquid in the liquid storage chamber 28 flows toward the plurality of liquid inlets 211, then absorbed by the first liquid conducting layer 22. The heating wire 23 contacts the first liquid conducting layer 22 to infiltrate the tobacco liquid, therefore, the heating wire 23 can be heated to generate an aerosol.

In some embodiments, as shown in FIG. 11, the numbers of the first liquid conducting layers 22 and the heating wires 23 are both three, each first liquid conducting layer 22 is corresponding with each liquid inlet disposed on side wall of the housing tube 21, that is, outside of each first liquid conducting layer 22 may infiltrate the tobacco liquid via the liquid inlet 211. Meanwhile, side wall of each first liquid conducting layer 22 contacts with side walls of other two first liquid conducting layers 22, as shown in M1 area in FIG. 11. The purpose is: three first liquid conducting layers 22 contact with each other to ensure fluidity of the tobacco liquid among three first liquid conducting layers 22. Single one first liquid conducting layer 22 in usage lacking tobacco liquid to produce burnt flavor would be avoided, as well as the electronic cigarette with three atomization cores is in favor of heating dissipation and generating larger volume of aerosol.

Figure 12:
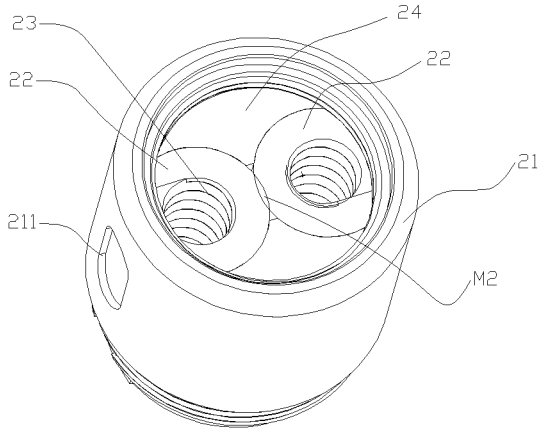
FIG. 12 is an isometric view of the atomization assembly having multiple atomization cores according to second embodiment of the present disclosure.

As shown in FIG. 12, an electronic cigarette with two atomization cores is disclosed, the main structure of the electronic cigarette is the same as the above electronic cigarette having three atomization cores, only one difference is that the number of the first liquid conducting layers 22 and the heating wires 23 are both two, each first liquid conducting layer 22 is corresponding to each liquid inlet 211 disposed on side wall of the housing tube 21. Meanwhile side wall of each first liquid conducting layer 22 contacts side wall of the other each first liquid conducting layer 22, as shown in M2 area in FIG. 12.

Figure 13:
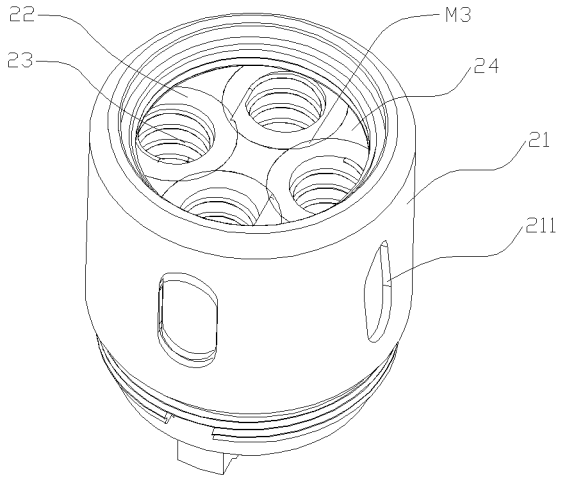
FIG. 13 is an isometric view of the atomization assembly having multiple atomization cores according to third embodiment of the present disclosure.

FIG. 13 shows the electronic cigarette having four atomization cores, the main structure of the electronic cigarette is the same as the above electronic cigarette having three atomization cores, only one difference is that the number of the first liquid conducting layers 22 and the heating wires 23 are both four, each first liquid conducting layer 22 is corresponding to each liquid inlet 211 disposed on side wall of the housing tube 21. Meanwhile side wall of each first liquid conducting layer 22 contacts side wall of the adjacent two first liquid conducting layers 22, as shown in M3 area in FIG. 13.

Of course, the number of the first liquid conducting layers 22 may be five, six or much more, with reiteration herein.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomization assembly comprising:

a housing tube; and at least one atomization core disposed in the housing tube;

wherein the atomization core comprises a heating element for heating and atomizing tobacco liquid, a first liquid conducting layer wrapped around the heating element, and a supporter disposed in the housing tube and configured for fixing the atomization core; wherein the supporter comprises at least one accommodation chamber for receiving the atomization core and at least one gap formed on a side wall of the supporter, in communication with the accommodation chamber; a second liquid conducting layer is wrapped around outside of the supporter; the second liquid conducting layer is in communication with the first liquid conducting layer by the gap to convey the tobacco liquid to the first liquid conducting layer.

2. The atomization assembly according to claim 1, wherein a side wall of the housing tube comprises a plurality of liquid inlets, at least part of the plurality of the liquid inlets are aligned with the gaps.

3. The atomization assembly according to claim 2, wherein a fracture surface formed by the first liquid conducting layer wrapped around the heating element is disposed in the gap, facing toward the liquid inlet that is aligned with the gap.

4. The atomization assembly according to claim 3, wherein the heating element is a spiral heating wire, a tubular heating net or a tubular heating piece; the first liquid conducting layer adopts a fiber cotton layer that is wrapped around outside the heating element, an aerosol tube is formed inside the heating element.

5. The atomization assembly according to claim 4, wherein the first liquid conducting layer adopts one fiber cotton layer that is wrapped around outside the heating element, the fracture surface formed by two ends of the fiber cotton layer wrapped together is disposed in the gap.

6. The atomization assembly according to claim 4, wherein the first liquid conducting layer adopts two fiber cotton layers that are wrapped around outside the heating element, the two fracture surfaces formed by four ends of the two fiber cotton layers wrapped together are disposed in the gap.

7. The atomization assembly according to claim 1, wherein the atomization assembly comprises more than two atomization cores, the supporter comprises more than two accommodation chambers accordingly; and a side wall of each accommodation chamber comprises a gap formed thereon; between every two adjacent accommodation chambers there is a liquid pipe for allowing the tobacco liquid to flow in.

8. The atomization assembly according to claim 7, wherein the side wall of the supporter, between two adjacent gaps, further comprises a liquid infiltrating hole in communication with the liquid pipe; the liquid infiltrating hole is communicated with two adjacent accommodation chambers that are corresponding to the two adjacent gaps, through the liquid pipe.

9. The atomization assembly according to claim 8, wherein the housing tube comprises a first liquid inlet and a second liquid inlet dispersed at interval on a side wall thereof.

10. The atomization assembly according to claim 9, wherein the first liquid inlet is aligned with the gap while the fracture surface formed by the first liquid conducting layer and disposed in the gap faces toward the first liquid inlet; the second liquid inlet is aligned with the liquid infiltrating hole.

11. The atomization assembly according to claim 1, wherein each of two ends of the heating element respectively comprises a connecting wire, one connecting wire is disposed outside the first liquid conducting layer, the other connecting wire is disposed inside the first liquid conducting layer.

12. The atomization assembly according to claim 1, wherein a thickness of the second liquid conducting layer is less than that of the first liquid conducting layer.

13. An atomizer comprising:

a shell component, having a tobacco liquid chamber formed therein; and an atomization assembly disposed inside the shell component and configured for heating tobacco liquid from the tobacco liquid chamber to generate an aerosol, comprising:

a housing tube; and an atomization core disposed in the housing tube;

wherein the atomization core comprises a heating element for heating and atomizing tobacco liquid, a first liquid conducting layer wrapped around the heating element, and a supporter disposed in the housing tube and configured for fixing the atomization core; wherein the supporter comprises an accommodation chamber for receiving the atomization core and at least one gap on a side wall of the supporter; a second liquid conducting layer is wrapped around outside of the supporter; the second liquid conducting layer is in communication with the first liquid conducting layer by the gap convey the tobacco liquid to the first liquid conducting layer.

14. An electronic cigarette comprising:

an atomizer, comprising:

a shell component, having a tobacco liquid chamber formed therein; and an atomization assembly disposed inside the shell component and configured for heating tobacco liquid from the tobacco liquid chamber to generate an aerosol, comprising:

a housing tube; and an atomization core disposed in the housing tube;

wherein the atomization core comprises a heating element for heating and atomizing tobacco liquid, a first liquid conducting layer wrapped around the heating element, and a supporter disposed in the housing tube and configured for fixing the atomization core; wherein the supporter comprises an accommodation chamber for receiving the atomization core and at least one gap on a side wall of the supporter; a second liquid conducting layer is wrapped around outside of the supporter; the second liquid conducting layer is in communication with the first liquid conducting layer by the gap to convey the tobacco liquid to the first liquid conducting layer; and a power supply, connected with the atomizer and configured for supplying power to the atomizer.

* * * * *